US010214320B2

(12) United States Patent
Dyle

(10) Patent No.: US 10,214,320 B2
(45) Date of Patent: Feb. 26, 2019

(54) STORAGE SYSTEM AND PROCESS OF MAKING AND USING THE SAME

(71) Applicant: GM Global Technology Operations LLC, Detroit, MI (US)

(72) Inventor: Taryn E. Dyle, Detroit, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 735 days.

(21) Appl. No.: 14/634,937

(22) Filed: Mar. 2, 2015

(65) Prior Publication Data

US 2015/0266619 A1 Sep. 24, 2015

Related U.S. Application Data

(60) Provisional application No. 61/954,995, filed on Mar. 18, 2014.

(51) Int. Cl.
*B65D 25/04* (2006.01)

(52) U.S. Cl.
CPC ..... *B65D 25/04* (2013.01); *Y10T 29/49826* (2015.01)

(58) Field of Classification Search
CPC .. B60R 5/04; B60R 5/044–5/045; B60R 7/02; B60R 21/06; B65D 25/04; B65D 11/1846; B65D 11/1873; B65D 5/48038; B65D 5/4804; B60N 2002/363; B60N 2/36; B60N 3/001–3/002
USPC ..... 220/4.28, 500, 507, 529–530, 6; 224/275, 282, 484, 496, 542–543, 224/549–550, 564; 296/24.43–24.44, 296/37.1, 37.14, 37.16, 37.5; 248/235; 29/428
See application file for complete search history.

(56) References Cited

U.S. PATENT DOCUMENTS 3,393,936 A * 7/1968 Hall ..... B60R 5/045 296/24.44
4,938,519 A * 7/1990 Schlachter ..... B60R 5/04 224/401
5,441,183 A * 8/1995 Frenzel ..... B60R 7/02 224/542
5,669,537 A 9/1997 Saleem et al.
6,406,083 B2 * 6/2002 Bharj ..... B60R 5/044 296/37.1

(Continued)

FOREIGN PATENT DOCUMENTS

CN 2178691 Y 10/1994
CN 2790929 Y 6/2006

(Continued)

OTHER PUBLICATIONS

German Office Action dated Sep. 18, 2015 ; Application No. 10 2015 103 374.7 ; Applicant: GM Global Technology Operations LLC; 4 pages.

(Continued)

*Primary Examiner* — Chun Cheung
*Assistant Examiner* — Brijesh V. Patel
(74) *Attorney, Agent, or Firm* — BrooksGroup

(57) ABSTRACT

A number of variations may include a system including an adjustable tray comprising at least one edge and a frame, wherein the tray is constructed and arranged to form a plurality of varying compartments within a partially enclosed space at least partially defined by the frame.

17 Claims, 6 Drawing Sheets

(56) References Cited

U.S. PATENT DOCUMENTS

| | | | | |
|---|---|---|---|---|
| 6,942,269 | B2 * | 9/2005 | Mains | B60N 3/001 108/44 |
| 7,086,678 | B2 * | 8/2006 | Schlecht | B60R 21/026 296/24.43 |
| 2005/0116486 | A1 * | 6/2005 | Walter | B60R 21/06 296/24.43 |
| 2006/0016840 | A1 * | 1/2006 | Svenson | B60R 5/04 224/42.32 |
| 2007/0018473 | A1 * | 1/2007 | Alliger | B60R 5/045 296/24.4 |
| 2007/0114808 | A1 * | 5/2007 | Yang | B60R 5/045 296/37.5 |
| 2010/0187857 | A1 * | 7/2010 | Fischer | B60R 5/04 296/184.1 |

FOREIGN PATENT DOCUMENTS

| | | | | |
|---|---|---|---|---|
| CN | 101795896 | A | 8/2010 | |
| CN | 203005941 | U | 6/2013 | |
| DE | 19721877 | A1 | 12/1997 | |
| DE | 102004040828 | A1 | 1/2006 | |
| DE | 102010022206 | A1 * | 11/2011 | B60N 2/3011 |
| KR | 20120081468 | A | 7/2012 | |

OTHER PUBLICATIONS

Chinese Office Action dated Jul. 6, 2016 ; Application No. 201510118410.0; Applicant: GM Global Technology Operations LLC; 9 pages.

U.S. Appl. No. 14/244,356, Rotatable and Stowable Parcel Shelf Assembly for a Motor Vehicle; filed Apr. 3, 2014.

* cited by examiner

STORAGE SYSTEM AND PROCESS OF MAKING AND USING THE SAME

CROSS-REFERENCE TO RELATED APPLICATIONS

This application claims the benefit of U.S. Provisional Application No. 61/954,995 filed Mar. 18, 2014.

TECHNICAL FIELD

The field to which the disclosure generally relates to compartment storage systems and processes of making and using the same.

BACKGROUND

Currently, some vehicles have storage components that may be capable of forming compartments in or on the interior or exterior of the vehicle.

SUMMARY OF ILLUSTRATIVE VARIATIONS OF THE INVENTION

A number of variations may include a system including an adjustable tray comprising at least one edge and a frame, wherein the tray may be constructed and arranged to form a plurality of varying compartments within a partially enclosed space at least partially defined by the frame.

A number of variations may include a product including a frame comprising at least one groove; and an adjustable tray comprising at least one edge and at least one joint capable of forming a bend in the tray at a range of 0° to about 90°, wherein the tray may be constructed and arranged to form a plurality of varying compartments within a partially enclosed space at least partially defined by the frame.

A number of variations may include a method including providing a frame comprising at least one groove; providing an adjustable tray comprising at least one edge and at least one joint capable of forming a bend in the tray at a range of 0° to about 90°, wherein the tray may be constructed and arranged to form a plurality of varying compartments within a partially enclosed space at least partially defined by the frame; and placing the tray edge within the frame groove to form at least one compartment.

Other illustrative variations of the invention will become apparent from the detailed description provided hereinafter. It should be understood that the detailed description and specific examples, while disclosing optional variations of the invention, are intended for purposes of illustration only and are not intended to limit the scope of the invention.

BRIEF DESCRIPTION OF THE DRAWINGS

Select examples of variations of the invention will become more fully understood from the detailed description and the accompanying drawings, wherein.

DETAILED DESCRIPTION OF ILLUSTRATIVE VARIATIONS OF THE INVENTION

The following description of the variations is merely illustrative in nature and is in no way intended to limit the invention, its application, or uses.

Figure 1:
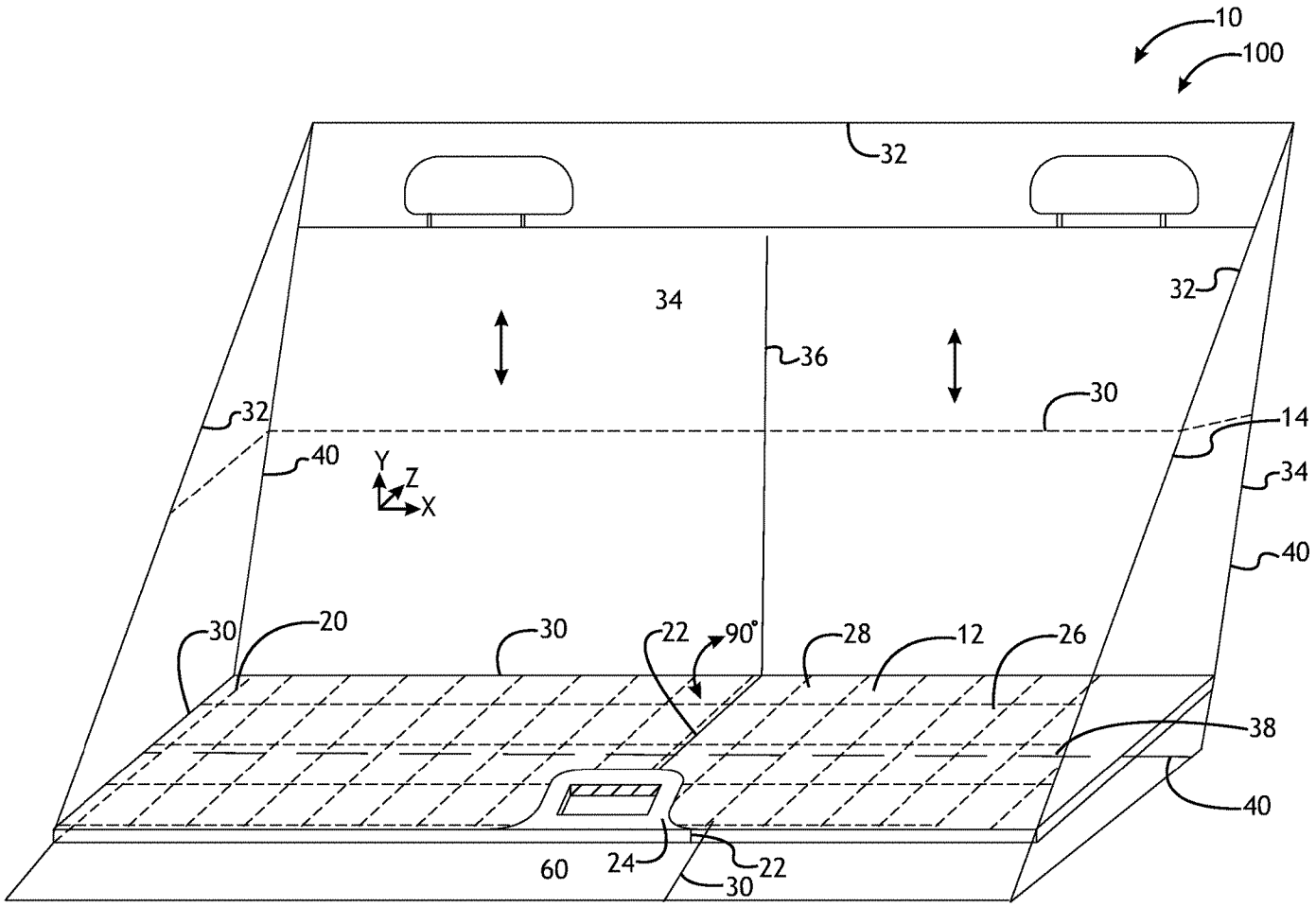
FIG. 1 is an illustration of a system and product according to a number of variations.

FIG. 1 shows an illustration of a system 10 and/or a product 100 according to a number of variations. The system 10 and/or product 100 may provide additional compartment combinations, providing more effective use of space. In a number of variations, a system 10 and/or product 100 may comprise a tray 12. In a number of variations, the tray 12 may be rigid to support a load. In a number of variations, the tray 12 may be adjustable, bendable, and/or flexible. In a number of variations, the tray 12 may comprise at least one edge 20. In a number of variations, the system 10 and/or product 100 may include a frame 14. In a number of variations, the frame 14 may be adjustable, bendable, and/or flexible. In a number of variations, the frame 14 may be rigid to support a load. In a number of variations, the frame 14 may comprise at least one groove 30. In a number of variations, the groove 30 may be constructed and arranged for accepting the edge 20 of the tray 12. In a number of variations, the tray 12 may be constructed and arranged to form a compartment within a partially enclosed space at least partially defined by the frame 14. In a number of variations, the tray 12 may be constructed and arranged to form a plurality of compartments within a partially enclosed space at least partially defined by the frame 14.

Figure 5:
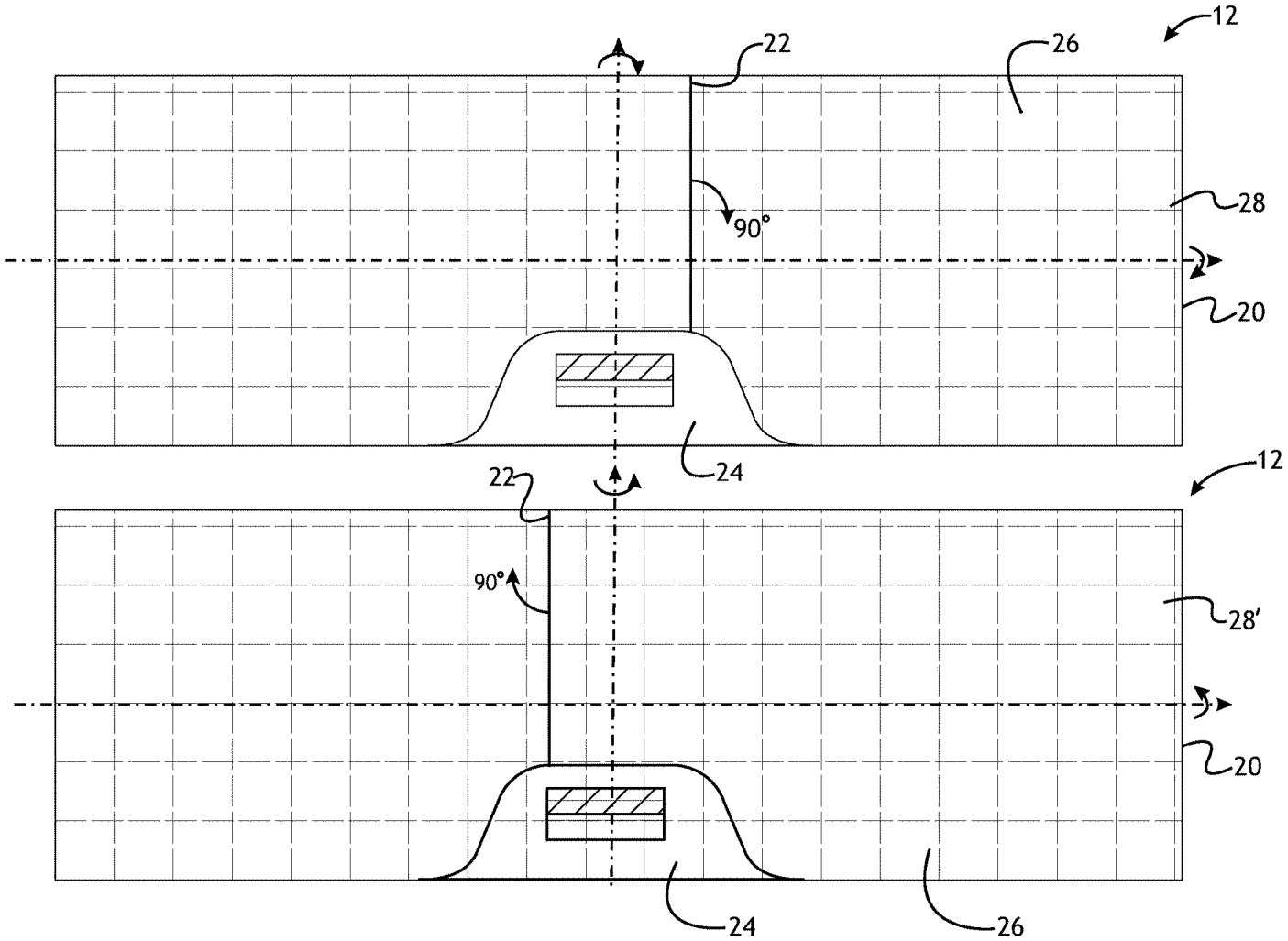
FIG. 5 is an illustration of a system and product according to a number of variations.
Figure 6:
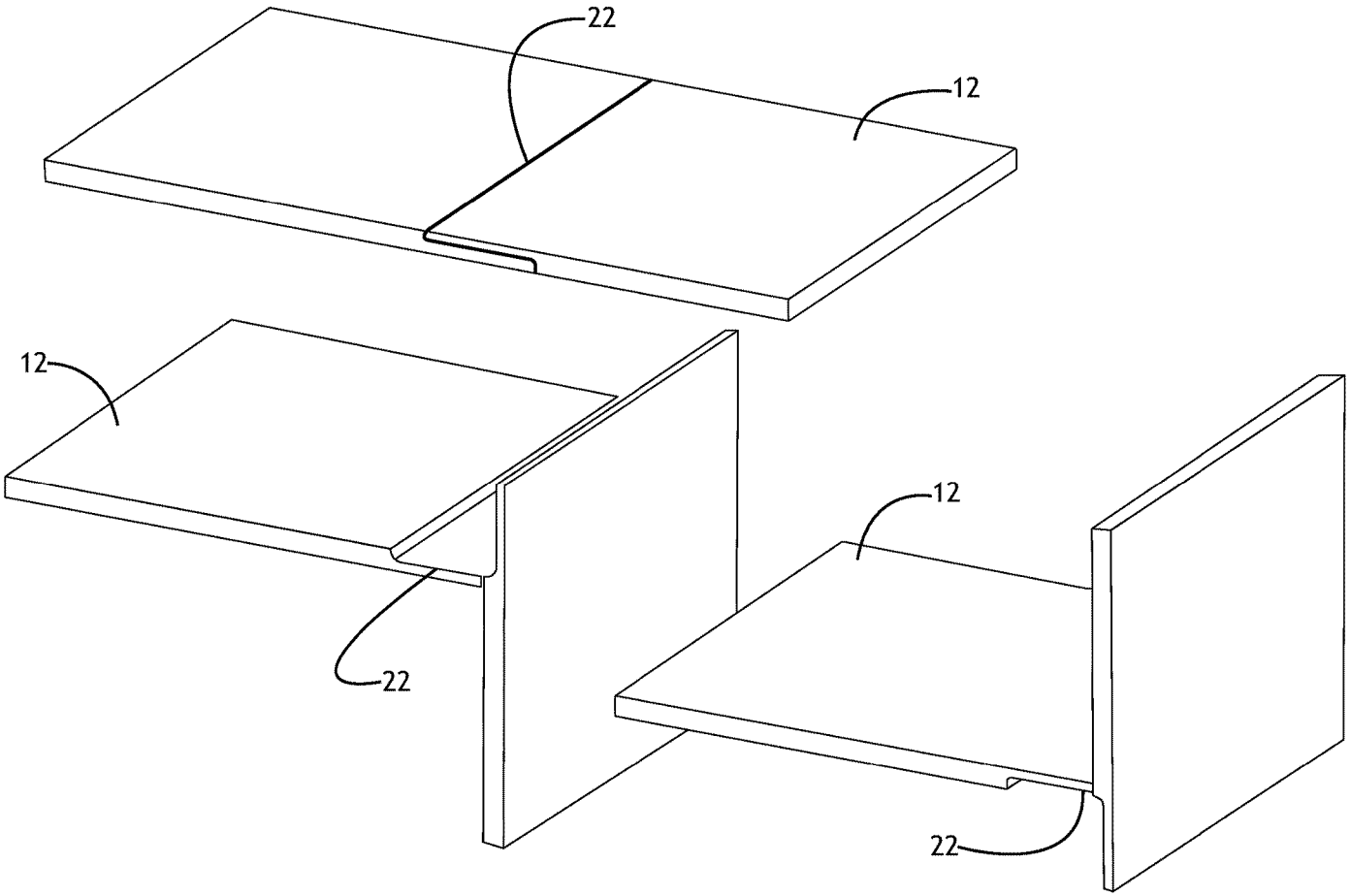
FIG. 6 is an illustration of a system and product according to a number of variations.

Still referring to FIG. 1 and now referring to FIG. 5, in a number of variations, the tray 12 may comprise a plurality of faces 28. In a number of variations, the tray 12 may comprise at least one joint 22. In a number of variations, the joint 22 may be located anywhere between the edges 20 of the tray 12. In a number of variations, the joint 22 may split the tray into two or more pieces. In a number of variations, the joint 22 may be located so as to split the surface area and/or overall area of the tray 12 at a ratio of 60:40. In a number of variations, the joint 22 may be located so as to split the surface area and/or overall area of the tray 12 at a ratio of 50:50. In a number of variations, the joint 22 may be located so as to split the surface area and/or overall area of the tray 12 at a ratio of 70:30. In a number of variations, the joint 22 may be located so as to split the surface area and/or overall area of the tray 12 at a ratio of 80:20. In a number of variations, the joint 22 may be located so as to split the surface area and/or overall area of the tray 12 at a ratio of 90:10. In a number of variations, the joint 22 may be capable of forming a bend in the tray 12 at a range of 0° to about 90°, and anywhere in between. In a number of variations, the joint 22 may be tapered. In a number of variations, the joint 22 may be straight edged. In a number of variations, the joint 22 may be a hinge joint. In a number of variations, the joint 22 may comprise a rod joint. In a number of variations, the joint 22 may include an overlap. FIG. 6 shows a variation of the joint 22 that may be used in incorporation with the tray 12. In a number of variations, the tray 12 may include at least two faces 28. Referring to FIG. 5, the tray 12 may be flipped over (180°) along its latitudinal axis to showcase two faces (A, B). On face A (28), the joint 22 of the tray 12 may bend or fold down at a range of 0° to about 90°. This may be referred to herein as orientation 1. If face A (28) may be rotated 180° along its longitudinal axis, the joint of the tray 12 may still bend or fold down at a range of 0° to about 90°, but the joint 22 will be on the opposite side of the tray 12. This may be referred to herein as orientation 2. Still referring to FIG. 5, the tray 12 may then be flipped over (180°) along its longitudinal axis to showcase face B of the tray 12. On face B (28'), the joint 22 of the tray 12 may bend or fold up at a range of 0° to about 90°. This may be referred to herein as orientation 3. If side B may be then rotated 180° along its longitudinal axis, the joint of the tray 12 may still bend or fold up at a range of 0° to about 90°, but the joint 22 will be on the opposite side of the tray 12. This may be referred to herein as orientation 4. In a number of variations, in this way, the tray 12 may fold down or up at a range of 0° to about 90° along the joint 22 in whatever orientation the tray may be placed within the groove 30 of the frame 14. In a number of variations, in this way, the tray 12 may fold up or down at a range of 0° to about 180° depending on whatever orientation the tray may be placed within the groove 30 of the frame 14. In a number of variations, the tray 12 may have multiple joints 22. In a number of variations, the tray 12 may include a series of crevices and ridges 26 according to the applications of the tray 12. In a number of variations, the tray 12 may include a handle 24. In a number of variations, the tray 12 may include the handle 24 and/or the crevices and ridges 26 on both faces 28, 28' of the tray 12. In a number of variations, the tray 12 may include a plurality of handles 24 on either face 28, 28' of the tray 12. In a number of variations, the tray 12 may comprise a plurality of legs (35) (not shown) capable of forming the tray 12 into a table.

Still referring to FIGS. 1 and 5, in a number of variations, the tray 12 may comprise a polymeric material. In a number of variations, the tray 12 may comprise a ceramic material. In a number of variations, the tray 12 may comprise a metal. In a number of variations, the tray 12 may comprise a fibrous material. In a number of variations, the tray 12 may comprise a plastic. In a number of variations, the tray 12 may comprise a material including, but not limited to, shellac, amber, aramid (including Twaron, Kevlar, Technora, Nomax), silk, rubber, synthetic rubber, phenol formaldehyde, neoprene, nylon, polyvinyl chloride, polystyrene, polyethylene, polypropylene, polyacrylonitrile, PVB, silicone, bioplastic, PET, PP, PVDC, PA PTFE, PEO, PPY, PANI, PT, PPS, PPV, PAC, polyester, vinyl polymer, polyolefin, polyacetylene, phenolic resin, polyanhydride, epoxy, phenolic, polyimide, PEEK, alumina, beryllia, ceria, zirconia, carbide, boride, nitride, silicide, porcelain, clay, quartz, alabaster, glass, kaolin, feldspar, steatite, petuntse, ferrite, earthenware, PZT, alpaca, angora, byssus, camel hair, cashmere, catgut, chiengora, guanaco, llama, leather, mohair, pashmina, qiviut, rabbit, silk, sinew, spider silk, wool, vicuna, yak, abaca', bagasse, balsa, bamboo, coir, cotton, flax, hemp, jute, kapok, kenaf, pina, raffia, ramie, sisal, wood, asbestos, acetate, triacetate, art silk, lyocell rayon, modal rayon, rayon, glass, silica, carbon, basalt, metallic, acrylic, microfiber, modacrylic, nylon, olefin, polyester, polyethylene, spandex, vinylon, vinyon, zylon, saran, carbon-fiber-reinforced polymer, carbon-fiber-reinforced plastic, carbon-fiber reinforced thermoplastic, or carbon nanotube reinforced polymer, fiber reinforced polymer, fiberglass (including E-glass, A-glass, E-CR-glass, C-glass, D-glass, R-glass, F-glass, S-glass, S-2-glass, Hexel, or may be another type), combinations thereof, or may be another type. In a number of variations, the tray 12 may comprise a parcel shelf assembly for a vehicle including, but not limited to, an automobile, plane, train, motorcycle, aircraft, watercraft, or spacecraft.

Still referring to FIG. 1, in a number of variations, the frame 14 may include at least one side 32. In a number of variations, the sides 32 may contain the groove 30. In a number of variations, the groove 30 may be a male/female groove. In a number of variations, the groove 30 may include a locking mechanism 37 for locking the tray 12 rigidly into the groove 30. In a number of variations, a side 32 may contain multiple grooves 30. In a number of variations, the frame 14 may include a well 60 at the base of the frame 14. In a number of variations, the frame 14 may comprise a polymeric material. In a number of variations, the frame 14 may comprise a ceramic material. In a number of variations, the frame 14 may comprise a metal. In a number of variations, the frame 14 may comprise a fibrous material. In a number of variations, the frame 14 may comprise a plastic. In a number of variations, the frame 14 may comprise a material including, but not limited to, shellac, amber, aramid (including Twaron, Kevlar, Technora, Nomax), silk, rubber, synthetic rubber, phenol formaldehyde, neoprene, nylon, polyvinyl chloride, polystyrene, polyethylene, polypropylene, polyacrylonitrile, PVB, silicone, bioplastic, PET, PP, PVDC, PA PTFE, PEO, PPY, PANI, PT, PPS, PPV, PAC, polyester, vinyl polymer, polyolefin, polyacetylene, phenolic resin, polyanhydride, epoxy, phenolic, polyimide, PEEK, alumina, beryllia, ceria, zirconia, carbide, boride, nitride, silicide, porcelain, clay, quartz, alabaster, glass, kaolin, feldspar, steatite, petuntse, ferrite, earthenware, PZT, alpaca, angora, byssus, camel hair, cashmere, catgut, chiengora, guanaco, llama, mohair, pashmina, qiviut, rabbit, silk, sinew, spider silk, wool, vicuna, yak, abaca', bagasse, balsa, bamboo, coir, cotton, flax, hemp, jute, kapok, kenaf, pina, raffia, ramie, sisal, wood, leather, asbestos, acetate, triacetate, art silk, lyocell rayon, modal rayon, rayon, glass, silica, carbon, basalt, metallic, acrylic, microfiber, modacrylic, nylon, olefin, polyester, polyethylene, spandex, vinylon, vinyon, zylon, saran, carbon-fiber-reinforced polymer, carbon-fiber-reinforced plastic, carbon-fiber reinforced thermoplastic, or carbon nanotube reinforced polymer, fiber reinforced polymer, fiberglass (including E-glass, A-glass, E-CR-glass, C-glass, D-glass, R-glass, F-glass, S-glass, S-2-glass, Hexel, or may be another type), combinations thereof, or may be another type. In a number of variations, the frame 14 may comprise the interior trim of a vehicle including, but not limited to, an automobile, plane, train, motorcycle, aircraft, watercraft, or spacecraft. In a number of variations, the frame 14 may comprise the exterior trim of a vehicle including, but not limited to, an automobile, plane, train, motorcycle, aircraft, watercraft, or spacecraft. In a number of variations, the frame 14 may further comprise a backing 34. In a number of variations, the backing 34 may be rigid. In a number of variations, the backing 34 may be adjustable, bendable, and/or flexible. In a number of variations, the backing 34 may comprise at least one edge 40. In a number of variations, the frame 14 may comprise the rear interior of a vehicle trim. In a number of variations, the backing 34 may comprise the rear of a vehicle seat. In a number of variations, the backing 34 may contain at least one divide 36. In a number of variations, the divide 36 may be located anywhere between the edges 40 of the backing 34. In a number of variations, the divide 36 may split the backing 34 into two or more pieces. In a number of variations, the divide 36 may be located so as to split the surface area and/or overall area of the backing 34 at a ratio of 60:40. In a number of variations, the divide 36 may be located so as to split the surface area and/or overall area of the backing 34 at a ratio of 50:50. In a number of variations, the divide 36 may be located so as to split the surface area and/or overall area of the backing 34 at a ratio of 70:30. In a number of variations, the divide 36 may be located so as to split the surface area and/or overall area of the backing 34 at a ratio of 80:20. In a number of variations, the divide 36 may be located so as to split the surface area and/or overall area of the backing 34 at a ratio of 90:10. In a number of variations, the backing 34 may contain at least one joint 38. In a number of variations, the joint 38 may be tapered. In a number of variations, the joint 38 may be straight edged. In a number of variations, the joint 38 may be a hinge joint. In a number of variations, the joint 38 may comprise a rod joint. In a number of variations, the joint 38 may include an overlap.

Referring to FIGS. 1-4, in a number of variations, the frame 14 may be oriented in the x-y direction of a three dimensional plane. In a number of variations, the joint 38 may be located along an edge 40 of the backing 34 to provide an ingress or egress of at least a portion of the backing 34 into space defined by the frame 14 in the z direction. In a number of variations, the joint 38 may be capable of forming a bend in the backing 34 at a range of about 0° to about 180°, and anywhere in between. In a number of variations, at least a portion of the backing 34 may be capable of bending to interact with the tray 12 to form additional varying compartments within the partially enclosed space at least partially defined by the frame 14. In a number of variations, the joint 38 may be bent to form a stagger between at least two separate pieces of the backing 34 along the divide 36, where the pieces may be at different positions in the z direction within the frame 14. In a number of variations, a plurality of joints 38 may be attached to the base of the backing. In a number of variations, a plurality of joints 38 may be attached to the base of at least one rear vehicle seat which may be divided by the divide 36, where the joints 38 allow for each individual seat to bend at a range of about 0° to about 180°, and anywhere in between, to ingress and egress in the z direction within the frame 14. In a number of variations, the divide 36 of the backing 34 and the joint 22 of the tray 12 may interact to provide additional various compartment combinations within the space at least partially defined by the frame 14. In a number of variations, the divide 36 of the backing 34 and the joint 22 of the tray 12 may align by splitting the area of the backing 34 and the tray 12 in equal ratios. In a number of variations, the tray 12 may bend in the x-y plane while the backing 34 bends in the z plane to allow for additional compartment combinations within the space at least partially defined by the frame 14.

Figure 2:
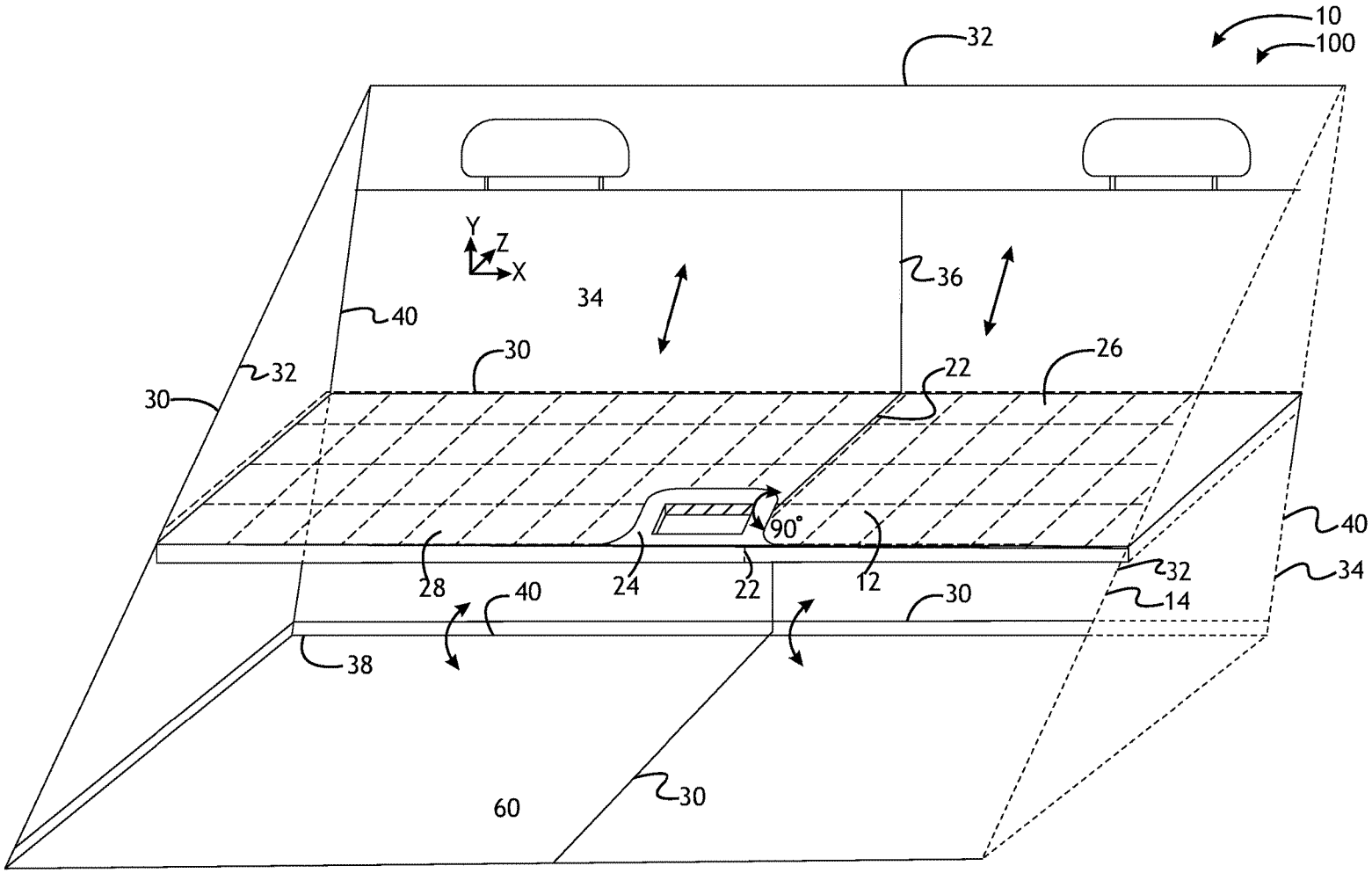
FIG. 2 is an illustration of a system and product according to a number of variations.
Figure 3:
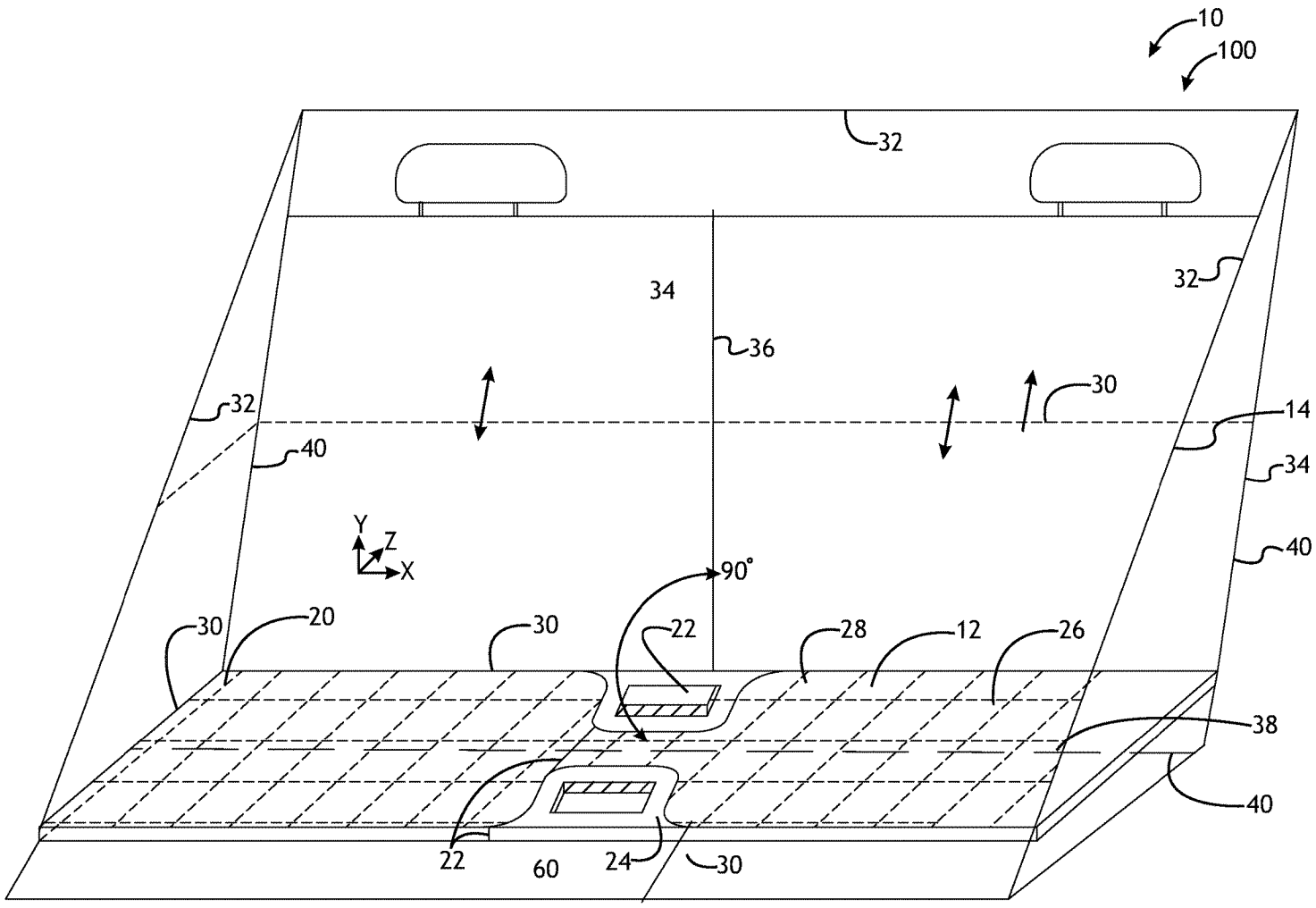
FIG. 3 is an illustration of a system and product according to a number of variations.
Figure 4:
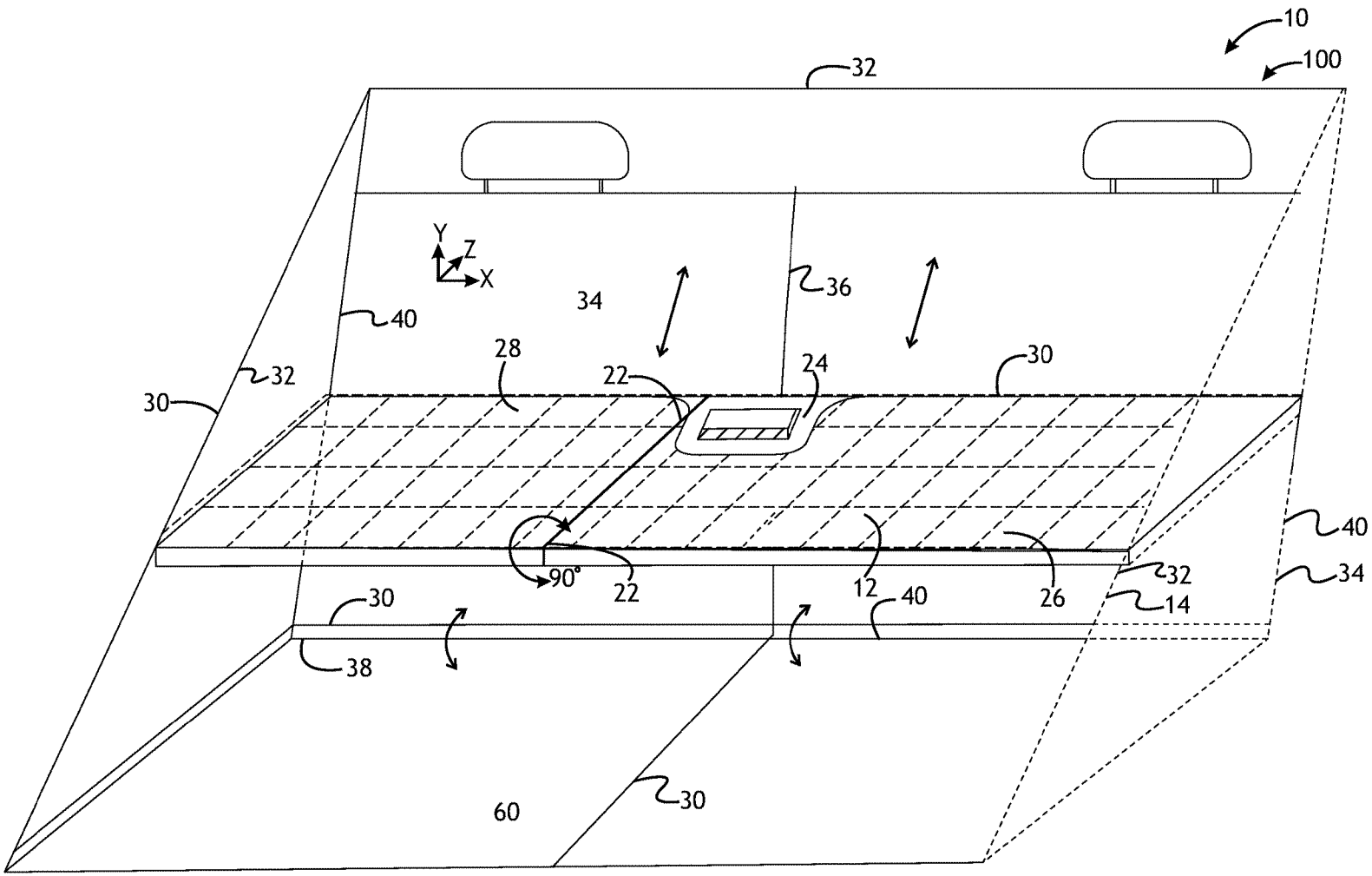
FIG. 4 is an illustration of a system and product according to a number of variations.

Referring to FIG. 1, the tray 12 (in orientation 4) may be located at the base of the frame 14 in the x-y plane above the well 60, wherein the joint 22 of the tray 12 (face B, 28') may be allowed to rotate or bend up at a range of 0° to about 90°. Referring to FIG. 1, the backing 34 comprising a rear vehicle seats along with the joint 38 and divide 36 may allow for ingress or egress of at least a portion of the backing 34 into and out of the x-y plane in the z direction. Referring to FIG. 2, the tray 12 (in orientation 1) may be located in the middle of the frame 14 in the x-y plane, wherein the joint 22 of the tray 12 (face A, 28) may be allowed to rotate or bend down at a range of 0° to about 90°. Referring to FIG. 2, the backing 34 comprising a rear vehicle seats along with the joint 38 and divide 36 may allow for ingress or egress of at least a portion of the backing 34 into and out of the x-y plane in the z direction. Referring to FIG. 3, the tray 12 (in orientation 3) may be located at the base of the frame 14 in the x-y plane above the well 60, wherein the joint 22 of the tray 12 (face B, 28') may be allowed to rotate or bend up at a range of 0° to about 90°. Referring to FIG. 3, the backing 34 comprising a rear vehicle seats along with the joint 38 and divide 36 may allow for ingress or egress of at least a portion of the backing 34 into and out of the x-y plane in the z direction. Referring to FIG. 4, the tray 12 (in orientation 2) may be located in the middle of the frame 14 in the x-y plane, wherein the joint 22 of the tray 12 (face A, 28) may be allowed to rotate or bend down at a range of 0° to about 90°. Referring to FIG. 4, the backing 34 comprising a rear vehicle seats along with the joint 38 and divide 36 may allow for ingress or egress of at least a portion of the backing 34 into and out of the x-y plane in the z direction.

In a number of variations, a method 200 may be shown wherein the method includes providing a frame 14 comprising at least one groove 30; providing an adjustable tray 12 comprising at least one edge 20 and at least one joint 22 capable of forming a bend in the tray 12 at a range of 0° to about 90°, wherein the tray 12 may be constructed and arranged to form a plurality of varying compartments within a partially enclosed space at least partially defined by the frame 14; placing the tray edge 20 within the frame groove 30 to form at least one compartment. In a number of variations, the method 200 further includes bending the tray along the joint at an angle of about 90° to form a plurality of compartments within a partially enclosed space at least partially defined by the frame. In a number of variations, the joint 22 may split the tray area at a ratio of 60:40. In a number of variations, the method 200 further includes bending the tray along the joint at an angle of about 90° to form a plurality of compartments within a partially enclosed space at least partially defined by the frame. In a number of variations, the method 200 may include wherein the frame further comprises a bendable backing 34 comprising the rear of a vehicle seat wherein the rear of the vehicle seat comprises a divide that splits the area of the backing at a ratio of 60:40. In a number of variations, the method 200 further includes bending at least a portion of the backing to form additional compartments within the partially enclosed space at least partially defined by the frame.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may include a system including an adjustable tray comprising at least one edge and a frame, wherein the tray is constructed and arranged to form a plurality of varying compartments within a partially enclosed space at least partially defined by the frame.

Variation 2 may include a system as set forth in Variation 1 wherein the tray comprises at least one joint capable of forming a bend in the tray at a range of 0° to about 90°.

Variation 3 may include a system as set forth in any of Variations 1-2 wherein the joint is located so as to split the tray area at a ratio of 60:40.

Variation 4 may include a system as set forth in any of Variations 1-3 wherein the frame comprises at least one groove.

Variation 5 may include a system as set forth in any of Variations 1-4 wherein the tray further comprises at least one handle.

Variation 6 may include a system as set forth in any of Variations 1-5 wherein the joint is tapered.

Variation 7 may include a system as set forth in any of Variations 1-6 wherein the frame comprises the rear interior of a vehicle trim.

Variation 8 may include a system as set forth in any of Variations 1-7 wherein the frame further comprises a backing comprising the rear of a vehicle seat.

Variation 9 may include a system as set forth Variation 8 wherein at least a portion of the backing is capable of bending to interact with the tray to form additional varying compartments within the partially enclosed space at least partially defined by the frame.

Variation 10 may include a system as set forth in any of Variations 8-9 wherein the rear of the vehicle seat contains a divide that splits the area of the backing at a ratio of 60:40 to align with the joint of the tray.

Variation 11 may include a product including a frame comprising at least one groove; and an adjustable tray comprising at least one edge and at least one joint capable of forming a bend in the tray at a range of 0° to about 90°, wherein the tray is constructed and arranged to form a plurality of varying compartments within a partially enclosed space at least partially defined by the frame.

Variation 12 may include a product as set forth in Variation 11 wherein the frame further comprises a bendable backing comprising the rear of a vehicle seat wherein the rear of the vehicle seat contains a divide capable of aligning with the joint of the tray within a partially enclosed space at least partially defined by the frame.

Variation 13 may include a method including providing a frame comprising at least one groove; providing an adjustable tray comprising at least one edge and at least one joint capable of forming a bend in the tray at a range of 0° to about 180°, wherein the tray is constructed and arranged to form a plurality of varying compartments within a partially enclosed space at least partially defined by the frame; and placing the tray edge within the frame groove to form at least one compartment.

Variation 14 may include a method as set forth in Variation 13 wherein the joint is located so as to split the tray area at a ratio of 60:40.

Variation 15 may include a method as set forth in any of Variations 13-14 further comprising bending the tray along the joint at an angle of about 90° up to form a plurality of compartments within a partially enclosed space at least partially defined by the frame.

Variation 16 may include a method as set forth in any of Variations 13-15 further comprising bending the tray along the joint at an angle of about 90° down to form a plurality of compartments within a partially enclosed space at least partially defined by the frame.

Variation 17 may include a method as set forth in any of Variations 13-16 wherein the frame further comprises a bendable backing comprising the rear of a vehicle seat wherein the rear of the vehicle seat comprises a divide that splits the area of the backing at a ratio of 60:40.

Variation 18 may include a method as set forth in Variation 17 further comprising bending at least a portion of the backing to form additional varying compartments within the partially enclosed space at least partially defined by the frame.

Variation 19 may include a method as set forth in Variation 18 further comprising bending the tray along the joint at an angle of about 90° up to form a plurality of compartments within a partially enclosed space at least partially defined by the frame.

Variation 20 may include a method as set forth in any of Variations 18-19 further comprising bending the tray along the joint at an angle of about 90° down to form a plurality of compartments within a partially enclosed space at least partially defined by the frame.

Variation 21 may include a system, a method, and/or a product as set forth in any of Variations 1-20 wherein the tray is rigid to support a load.

Variation 22 may include a system, a method, and/or a product as set forth in any of Variations 1-21 wherein the tray is adjustable, bendable, and/or flexible.

Variation 23 may include a system, a method, and/or a product as set forth in any of Variations 1-22 wherein the frame is rigid to support a load.

Variation 24 may include a system, a method, and/or a product as set forth in any of Variations 1-23 wherein the frame is adjustable, bendable, and/or flexible.

Variation 25 may include a system, a method, and/or a product as set forth in any of Variations 1-24 wherein the groove is constructed and arranged for accepting an edge of the tray.

Variation 26 may include a system, a method, and/or a product as set forth in any of Variations 1-25 wherein the tray comprises a plurality of faces.

Variation 27 may include a system, a method, and/or a product as set forth in any of Variations 1-26 wherein the tray comprises a joint located so as to split the surface area and/or overall area of the tray at a ratio of 50:50.

Variation 28 may include a system, a method, and/or a product as set forth in any of Variations 1-27 wherein the tray comprises a joint located so as to split the surface area and/or overall area of the tray at a ratio of 70:30.

Variation 29 may include a system, a method, and/or a product as set forth in any of Variations 1-28 wherein the tray comprises a joint located so as to split the surface area and/or overall area of the tray at a ratio of 80:20.

Variation 30 may include a system, a method, and/or a product as set forth in any of Variations 1-29 wherein the tray comprises a joint located so as to split the surface area and/or overall area of the tray at a ratio of 90:10.

Variation 31 may include a system, a method, and/or a product as set forth in any of Variations 1-30 wherein the tray comprises a joint that is tapered.

Variation 32 may include a system, a method, and/or a product as set forth in any of Variations 1-31 wherein the tray comprises a joint that is straight edged.

Variation 33 may include a system, a method, and/or a product as set forth in any of Variations 1-32 wherein the tray comprises a joint comprises a hinge joint.

Variation 34 may include a system, a method, and/or a product as set forth in any of Variations 1-33 wherein the tray comprises a joint comprises a rod joint.

Variation 35 may include a system, a method, and/or a product as set forth in any of Variations 1-34 wherein the tray comprises a joint comprises an overlap.

Variation 36 may include a system, a method, and/or a product as set forth in any of Variations 1-35 wherein the tray comprises multiple joints.

Variation 37 may include a system, a method, and/or a product as set forth in any of Variations 1-36 wherein the tray comprises a series of crevices and ridges.

Variation 38 may include a system, a method, and/or a product as set forth in any of Variations 1-37 wherein the tray comprises a plurality of handles.

Variation 39 may include a system, a method, and/or a product as set forth in any of Variations 1-38 wherein the tray comprises a plurality of legs.

Variation 40 may include a system, a method, and/or a product as set forth in any of Variations 1-39 wherein the tray comprises a polymeric material.

Variation 41 may include a system, a method, and/or a product as set forth in any of Variations 1-40 wherein the tray comprises a ceramic material.

Variation 42 may include a system, a method, and/or a product as set forth in any of Variations 1-41 wherein the tray comprises a metal.

Variation 43 may include a system, a method, and/or a product as set forth in any of Variations 1-42 wherein the tray comprises a fibrous material.

Variation 44 may include a system, a method, and/or a product as set forth in any of Variations 1-43 wherein the tray comprises a plastic.

Variation 45 may include a system, a method, and/or a product as set forth in any of Variations 1-44 wherein the tray comprises shellac, amber, aramid (including Twaron, Kevlar, Technora, Nomax), silk, rubber, synthetic rubber, phenol formaldehyde, neoprene, nylon, polyvinyl chloride, polystyrene, polyethylene, polypropylene, polyacrylonitrile, PVB, silicone, bioplastic, PET, PP, PVDC, PA PTFE, PEO, PPY, PANI, PT, PPS, PPV, PAC, polyester, vinyl polymer, polyolefin, polyacetylene, phenolic resin, polyanhydride, epoxy, phenolic, polyimide, PEEK, alumina, beryllia, ceria, zirconia, carbide, boride, nitride, silicide, porcelain, clay, quartz, alabaster, glass, kaolin, feldspar, steatite, petuntse, ferrite, earthenware, PZT, alpaca, angora, byssus, camel hair, cashmere, catgut, chiengora, guanaco, llama, leather, mohair, pashmina, qiviut, rabbit, silk, sinew, spider silk, wool, vicuna, yak, abaca', bagasse, balsa, bamboo, coir, cotton, flax, hemp, jute, kapok, kenaf, pina, raffia, ramie, sisal, wood, asbestos, acetate, triacetate, art silk, lyocell rayon, modal rayon, rayon, glass, silica, carbon, basalt, metallic, acrylic, microfiber, modacrylic, nylon, olefin, polyester, polyethylene, spandex, vinylon, vinyon, zylon, saran, carbon-fiber-reinforced polymer, carbon-fiber-reinforced plastic, carbon-fiber reinforced thermoplastic, or carbon nanotube reinforced polymer, fiber reinforced polymer, fiberglass (including E-glass, A-glass, E-CR-glass, C-glass, D-glass, R-glass, F-glass, S-glass, S-2-glass, Hexel, or may be another type), or combinations thereof.

Variation 46 may include a system, a method, and/or a product as set forth in any of Variations 1-45 wherein the tray comprises a parcel shelf assembly for a vehicle including, but not limited to, an automobile, plane, train, motorcycle, aircraft, watercraft, or spacecraft.

Variation 47 may include a system, a method, and/or a product as set forth in any of Variations 1-46 wherein the frame comprises a groove comprising a male/female groove.

Variation 48 may include a system, a method, and/or a product as set forth in any of Variations 1-47 wherein frame comprises a groove comprising a locking mechanism.

Variation 49 may include a system, a method, and/or a product as set forth in any of Variations 1-48 wherein the frame comprises a side comprising multiple grooves.

Variation 50 may include a system, a method, and/or a product as set forth in any of Variations 1-49 wherein the frame further comprises a well at the base of the frame.

Variation 51 may include a system, a method, and/or a product as set forth in any of Variations 1-50 wherein the frame comprises a polymeric material.

Variation 52 may include a system, a method, and/or a product as set forth in any of Variations 1-51 wherein the frame comprises a ceramic material.

Variation 53 may include a system, a method, and/or a product as set forth in any of Variations 1-52 wherein the frame comprises a metal.

Variation 54 may include a system, a method, and/or a product as set forth in any of Variations 1-53 wherein the frame comprises a fibrous material.

Variation 55 may include a system, a method, and/or a product as set forth in any of Variations 1-54 wherein the frame comprises a plastic.

Variation 56 may include a system, a method, and/or a product as set forth in any of Variations 1-55 wherein the frame comprises shellac, amber, aramid (including Twaron, Kevlar, Technora, Nomax), silk, rubber, synthetic rubber, phenol formaldehyde, neoprene, nylon, polyvinyl chloride, polystyrene, polyethylene, polypropylene, polyacrylonitrile, PVB, silicone, bioplastic, PET, PP, PVDC, PA PTFE, PEO, PPY, PANI, PT, PPS, PPV, PAC, polyester, vinyl polymer, polyolefin, polyacetylene, phenolic resin, polyanhydride, epoxy, phenolic, polyimide, PEEK, alumina, beryllia, ceria, zirconia, carbide, boride, nitride, silicide, porcelain, clay, quartz, alabaster, glass, kaolin, feldspar, steatite, petuntse, ferrite, earthenware, PZT, alpaca, angora, byssus, camel hair, cashmere, catgut, chiengora, guanaco, llama, leather, mohair, pashmina, qiviut, rabbit, silk, sinew, spider silk, wool, vicuna, yak, abaca', bagasse, balsa, bamboo, coir, cotton, flax, hemp, jute, kapok, kenaf, pina, raffia, ramie, sisal, wood, asbestos, acetate, triacetate, art silk, lyocell rayon, modal rayon, rayon, glass, silica, carbon, basalt, metallic, acrylic, microfiber, modacrylic, nylon, olefin, polyester, polyethylene, spandex, vinylon, vinyon, zylon, saran, carbon-fiber-reinforced polymer, carbon-fiber-reinforced plastic, carbon-fiber reinforced thermoplastic, or carbon nanotube reinforced polymer, fiber reinforced polymer, fiberglass (including E-glass, A-glass, E-CR-glass, C-glass, D-glass, R-glass, F-glass, S-glass, S-2-glass, Hexel, or may be another type), or combinations thereof.

Variation 57 may include a system, a method, and/or a product as set forth in any of Variations 1-56 wherein the frame comprises the interior trim of a vehicle including, but not limited to, an automobile, plane, train, motorcycle, aircraft, watercraft, or spacecraft.

Variation 58 may include a system, a method, and/or a product as set forth in any of Variations 1-57 wherein the frame comprises the exterior trim of a vehicle including, but not limited to, an automobile, plane, train, motorcycle, aircraft, watercraft, or spacecraft.

Variation 59 may include a system, a method, and/or a product as set forth in any of Variations 1-58 wherein backing is rigid.

Variation 60 may include a system, a method, and/or a product as set forth in any of Variations 1-59 wherein the backing is adjustable, bendable, and/or flexible.

Variation 61 may include a system, a method, and/or a product as set forth in any of Variations 1-60 wherein the backing comprises a divide located so as to split the surface area and/or overall area of the backing at a ratio of 50:50.

Variation 62 may include a system, a method, and/or a product as set forth in any of Variations 1-61 wherein the backing comprises a divide located so as to split the surface area and/or overall area of the backing at a ratio of 70:30.

Variation 63 may include a system, a method, and/or a product as set forth in any of Variations 1-62 wherein the backing comprises a divide located so as to split the surface area and/or overall area of the backing at a ratio of 80:20.

Variation 64 may include a system, a method, and/or a product as set forth in any of Variations 1-63 wherein the backing comprises a divide located so as to split the surface area and/or overall area of the backing at a ratio of 90:10.

Variation 65 may include a system, a method, and/or a product as set forth in any of Variations 1-64 wherein the backing comprises a joint that is tapered.

Variation 66 may include a system, a method, and/or a product as set forth in any of Variations 1-65 wherein the backing comprises a joint that is straight edged.

Variation 67 may include a system, a method, and/or a product as set forth in any of Variations 1-66 wherein the backing comprises a joint comprises a hinge joint.

Variation 68 may include a system, a method, and/or a product as set forth in any of Variations 1-67 wherein the backing comprises a joint comprises a rod joint.

Variation 69 may include a system, a method, and/or a product as set forth in any of Variations 1-68 wherein the backing comprises a joint comprises an overlap.

Variation 70 may include a system, a method, and/or a product as set forth in any of Variations 1-69 wherein the backing comprises multiple joints.

Variation 71 may include a system, a method, and/or a product as set forth in any of Variations 1-70 wherein the backing comprises a joint that provides ingress or egress of at least a portion of the backing into the space defined by the frame.

Variation 72 may include a system, a method, and/or a product as set forth in any of Variations 1-71 wherein the backing comprises a joint capable of forming a bend in the backing 34 at a range of about 0° to about 180°.

Variation 73 may include a system, a method, and/or a product as set forth in any of Variations 1-72 wherein the backing comprises a joint that forms a stagger between at least two separate pieces of the backing along the divide, wherein the pieces are at different positions in the z direction within the frame.

Variation 74 may include a system, a method, and/or a product as set forth in any of Variations 1-73 wherein the backing comprises at least one joint attached to the base of at least one rear vehicle seat.

Variation 75 may include a system, a method, and/or a product as set forth in any of Variations 1-74 wherein the backing comprises a plurality of joints which are attached to the base of several rear vehicle seats which may be divided by the divide, wherein the joints allow for each individual seat to bend at a range of about 0° to about 180°, and anywhere in between, to ingress and egress in the z direction within the frame.

Variation 76 may include a system, a method, and/or a product as set forth in any of Variations 1-75 wherein the divide of the backing and the joint of the tray align to split the area of the backing and the tray in equal ratios to allow for additional compartment combinations within the space at least partially defined by the frame.

The above description of select examples of the invention is merely exemplary in nature and, thus, variations or variants thereof are not to be regarded as a departure from the spirit and scope of the invention.

What is claimed is:

1. A system comprising: an adjustable tray comprising at least one edge and a frame, wherein the adjustable tray further comprises a first portion, a second portion, and a tapered overlapping joint disposed there between constructed and arranged to bend to form a plurality of varying compartments within a partially enclosed space at least partially defined by the frame;

wherein the tapered overlapping joint includes at least part of the first portion overlapping at least part of the second portion;

wherein the frame comprises at least one groove, a rear interior of a vehicle trim and a backing comprising a rear of a vehicle seat; and wherein at least a portion of the backing is constructed and arranged to bend to interact with the adjustable tray to form additional varying compartments within the partially enclosed space at least partially defined by the frame.

2. A system as set forth in claim 1 wherein the tapered overlapping joint arranged to form a bend in the adjustable tray at a range of 0° to about 90°.

3. A system as set forth in claim 2 wherein the tapered overlapping joint is located so as to split the adjustable tray at a ratio of 60:40.

4. A system as set forth in claim 2 wherein the tapered overlapping joint is tapered.

5. A system as set forth in claim 1 wherein the at least one groove is constructed and arranged to accept the adjustable tray.

6. A system as set forth in claim 1 wherein the adjustable tray further comprises at least one handle.

7. A system as set forth in claim 1 wherein the rear of the vehicle seat contains a divide that splits an area of the backing at a ratio of 60:40 to align with the tapered overlapping joint of the adjustable tray.

8. A product comprising:

a frame comprising at least one groove and a backing; and an adjustable tray comprising at least one edge and a plurality of joints each constructed and arranged to form a plurality of bends in the adjustable tray at a range of 0° to about 90°, wherein the adjustable tray is constructed and arranged to form a plurality of varying compartments within a partially enclosed space at least partially defined by the frame and wherein at least a portion of the backing is constructed and arranged to bend to interact with the adjustable tray to form additional varying compartments within the partially enclosed space at least partially defined by the frame; and wherein the plurality of joints each consist of a tapered overlapping joint which includes at least a first portion overlapping at least a second portion.

9. A product as set forth in claim 8 wherein the frame further comprises a bendable backing comprising a rear of a vehicle seat wherein the rear of the vehicle seat contains a divide constructed and arranged to align with at least one joint of the plurality of joints of the adjustable tray to form additional varying compartments within the partially enclosed space at least partially defined by the frame.

10. A method comprising:

providing a frame comprising at least one groove and a backing;

providing an adjustable tray comprising at least one edge and a plurality of joints constructed and arranged to form a plurality of bends in the adjustable tray at a range of 0° to about 90°, wherein the adjustable tray and the backing are constructed and arranged to form a plurality of compartments within a partially enclosed space at least partially defined by the frame; and wherein the plurality of joints each includes a tapered overlapping joint consisting of at least part a first portion overlapping at least a second portion; and placing the at least one edge within the at least one frame groove to form at least one compartment.

11. A method as set forth in claim 10 wherein at least one joint of the plurality of joints is located so as to split the adjustable tray at a ratio of 60:40.

12. A method as set forth in claim 10 further comprising bending the adjustable tray along at least one joint of the plurality of joints at an angle of about 90° up to form a plurality of compartments within the partially enclosed space at least partially defined by the frame.

13. A method as set forth in claim 10 further comprising bending the adjustable tray along at least one joint of the plurality of joints at an angle of about 90° down to form a plurality of compartments within the partially enclosed space at least partially defined by the frame.

14. A method as set forth in claim 10 wherein the frame further comprises a bendable backing comprising the rear of a vehicle seat wherein the rear of the vehicle seat comprises a divide that splits the area of the backing at a ratio of 60:40.

15. A method as set forth in claim 14 further comprising bending at least a portion of the backing to form additional varying compartments within the partially enclosed space at least partially defined by the frame.

16. A method as set forth in claim 15 further comprising bending the adjustable tray along at least one joint of the plurality of joints at an angle of about 90° up to form a plurality of compartments within the partially enclosed space at least partially defined by the frame.

17. A method as set forth in claim 15 further comprising bending the adjustable tray along at least one joint of the plurality of joints at an angle of about 90° down to form a plurality of compartments within the partially enclosed space at least partially defined by the frame.

* * * * *